US005829348A

United States Patent [19]

Morgan

[11] Patent Number: 5,829,348

[45] Date of Patent: Nov. 3, 1998

[54] CAN CRUSHER AND STORAGE SYSTEM

[76] Inventor: Roger E. Morgan, 450 Tieman La., St. Peters, Mo. 63376

[21] Appl. No.: 920,834

[22] Filed: Aug. 29, 1997

[51] Int. Cl.[6] ..... B30B 9/32

[52] U.S. Cl. ..... 100/48; 100/131; 100/215; 100/218; 100/289; 100/902

[58] Field of Search ..... 100/48, 53, 131–134, 100/215, 218, 289, 902; 138/120, 155

[56] References Cited

U.S. PATENT DOCUMENTS

| | | | |
|---|---|---|---|
| 2,800,159 | 7/1957 | Walsh et al. | 100/902 |
| 3,024,720 | 3/1962 | Welsh | 100/902 |
| 3,204,550 | 9/1965 | Swiderski et al. | 100/902 |
| 3,580,167 | 5/1971 | Simshauser | 100/902 |
| 3,926,222 | 12/1975 | Shroy et al. | 138/155 |
| 4,103,609 | 8/1978 | Hiatt | 100/902 |
| 4,814,071 | 3/1989 | Lower | 138/120 |
| 4,865,362 | 9/1989 | Holden | 138/120 |
| 5,048,413 | 9/1991 | Deiters | 100/902 |
| 5,143,123 | 9/1992 | Richards et al. | 138/120 |
| 5,287,803 | 2/1994 | Cole | 100/902 |
| 5,456,166 | 10/1995 | Belongia et al. | 100/902 |

FOREIGN PATENT DOCUMENTS

| | | | |
|---|---|---|---|
| 58-116997 | 7/1983 | Japan | 100/902 |
| 59-50998 | 3/1984 | Japan | 100/902 |
| 62-224500 | 10/1987 | Japan | 100/902 |
| 6-23593 | 2/1994 | Japan | 100/902 |

*Primary Examiner*—Stephen F. Gerrity

[57] ABSTRACT

A can crusher and storage system is provided including a piston housing having a first face, a second face, and a periphery formed therebetween defining an interior space. The piston housing has an inlet formed in the periphery thereof adjacent the first face. A thin rectangular outlet is formed in the periphery of the piston housing between the inlet and the first face and is further situated opposite of and offset from the inlet. Next provided is a piston assembly situated within the interior space of the piston housing for crushing cans situated within the inlet upon the actuation thereof. A control assembly is provided for selectively actuating the piston assembly.

18 Claims, 5 Drawing Sheets

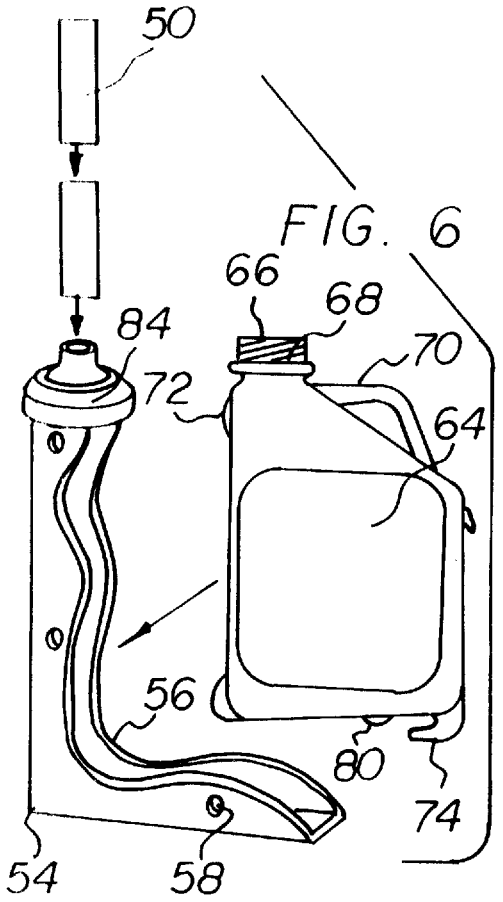
FIG. 6
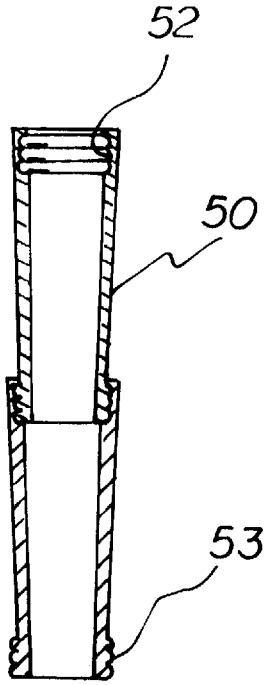
FIG 7
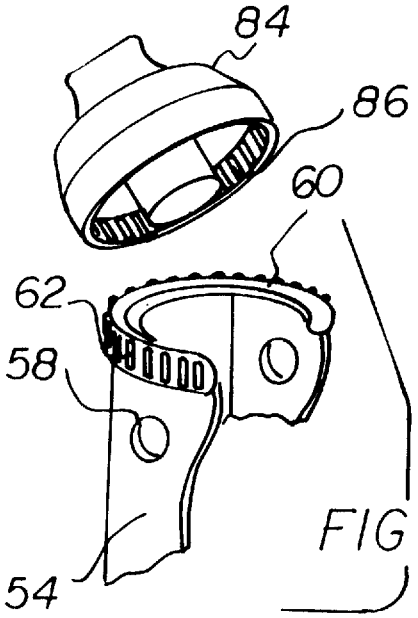
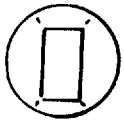
FIG. 8
FIG. 9

CAN CRUSHER AND STORAGE SYSTEM

BACKGROUND OF THE INVENTION

1. Field of the Invention

The present invention relates to a can crusher and storage system and more particularly pertains to crushing cans and further storing such crushed cans in a container prior to recycling.

2. Description of the Prior Art

The use of can compactors is known in the prior art. More specifically, can compactors heretofore devised and utilized for the purpose of crushing cans are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,067,398; U.S. Pat. No. 5,188,022; U.S. Pat. No. 4,216,713; U.S. Pat. Des. No. 253,771; U.S. Pat. No. 4,561,350; and U.S. Pat. No. 4,970,951.

In this respect, the can crusher and storage system according to the present invention substantially departs from the conventional concepts and designs of the prior art, and in so doing provides an apparatus primarily developed for the purpose of crushing cans and further storing such crushed cans in a container prior to recycling.

Therefore, it can be appreciated that there exists a continuing need for a new and improved can crusher and storage system which can be used for crushing cans and further storing such crushed cans in a container prior to recycling. In this regard, the present invention substantially fulfills this need.

SUMMARY OF THE INVENTION

In view of the foregoing disadvantages inherent in the known types of can compactors now present in the prior art, the present invention provides an improved can crusher and storage system. As such, the general purpose of the present invention, which will be described subsequently in greater detail, is to provide a new and improved can crusher and storage system which has all the advantages of the prior art and none of the disadvantages.

To attain this, the present invention essentially comprises a piston housing having a cylindrical configuration. As shown in FIG. 1, the piston housing has a first circular face, a second circular face, and a tubular periphery formed therebetween defining an interior space. A rectangular inlet is formed in the periphery of the piston housing adjacent the first circular face with a recessed lip formed about an inner periphery of the inlet. A spring biased lid is hingably coupled over the inlet with a biased open orientation and an unbiased closed orientation. A thin rectangular outlet is formed in the periphery of the piston housing between the inlet and the first circular face. As shown in FIG. 1, the outlet is further situated diametrically opposite of and offset from the inlet. As best shown in FIGS. 3–5, a rectangular chute is integrally coupled about the outlet and extends radially therefrom. For reasons that will become apparent later, a plurality of undulations are formed about an outer surface of the chute. With references still to FIGS. 3–5, it is shown that a piston assembly is provided including a motor mounted within the interior space of the piston housing adjacent the second circular face thereof. A screwdriver shaft is coupled to a rotor of the motor and extends in concentric relationship with the piston housing. A piston with a cylindrical configuration is slidably situated within the interior space of the piston housing with a threaded coaxial bore formed therein for threadedly receiving the screwdriver shaft. Upon the actuation of the motor, the motor is adapted to rotate the screwdriver shaft such that the piston engages the first circular face and subsequently retracts to a rest position adjacent the motor. As such, a can is crushed when inserted within the inlet thereby allowing the expelling of the crushed can through the outlet for disposal. For controlling the operation of the piston assembly, an electrical control assembly is included. Such assembly includes a pair of contacts situated on the recessed lip of the inlet of the piston housing. Associated therewith is a conductive tab mounted on the lid. Upon the lid residing in the open orientation thereof, a first activation signal is transmitted. When the lid is in the closed orientation thereof, a second activation signal is transmitted. The electrical control assembly further includes a push button mounted on an exterior of the piston housing. During use, the push button serves for generating a third activation signal upon the depression thereof. The electrical control assembly further includes a mode switch situated on the exterior of the piston housing for effecting the operation of the electrical control assembly in a first mode of operation in a first orientation and effecting the operation of the control assembly in a second mode of operation in a second orientation. Finally, unillustrated control means is connected between the motor, contacts, push button, and mode switch. In use, the control means functions to effect the actuation of the motor after a predetermined amount of time upon the receipt of the first activation signal and the subsequent receipt of the second activation signal in the first mode of operation. As such, the crushing of the can is effected upon the opening and subsequent closing of the lid. The electrical control assembly is further adapted to effect the immediate actuation of the motor upon the receipt of the third activation signal in the second mode operation. In such mode, the crushing of the can is effected upon the depression of the push button. With attention now to FIGS. 6 & 7, a plurality of dispensing adapters each have a hollow rectangular cross-section with a pair of open ends. Each of the dispensing adapters have a top end with a plurality of peripheral undulations formed on an interior surface thereof. A bottom end of each of the dispensing adapters are equipped with a plurality of peripheral undulations formed on an exterior surface thereof. By this structure, the dispensing adapters may be coupled in linear alignment and further coupled to the chute of the piston housing for receiving a crushed can dispensed therefrom. Also included is a mounting base having an L-shaped configuration, as shown in FIGS. 1, 6 & 9. The mounting base is equipped with a pair of side walls defining an L-shaped channel. The mounting base further has a plurality of apertures formed therein for fixedly coupling the same to a recipient surface. As best shown in FIG. 9, the mounting base has a C-shaped top having a plurality of ridges formed on an exterior surface thereof. As shown in FIG. 10, a hollow container is included having a top face, a bottom face, a front face, a rear face, and a pair of side faces integrally coupled therebetween thereby defining an interior space. The container has a circular opening formed on the top face adjacent the front face of the container. A peripheral lip is coupled about the circular opening and extends upwardly therefrom. An inverted V-shaped handle is integrally coupled to the top face of the container. A pair of protrusions are integrally formed in the front face and extend outwardly therefrom. For facilitating the handling of the container, a gripping arm is integrally coupled to the bottom face of the container adjacent the rear face thereof. A gripping inset portion is integrally formed in the rear face of the container adjacent to the top face thereof for facilitating the handling of the container, similar to the gripping arm. A locking bump is formed in the bottom face of the container and extends downwardly therefrom for engaging a complimentary bump formed in the mounting base when the container is situated within the L-shaped channel of the mounting base. The bumps work together for maintaining the container within the mounting base such that the circular opening of the container is in coaxial alignment with the C-shaped top of the mounting base. The bottom face of the container has a beveled upper surface within the interior space of the container for effecting the flow of fluid to the front face of the container. FIGS. 8 & 9 show an interconnect having an upper extent with a rectangular cross-section. The upper extent has a plurality of peripheral undulations formed in an interior surface thereof for engaging those of the bottom end of the one of the dispensing adapters. The interconnect further has a lower extent with a circular cross-section. A plurality of indentations are formed in an interior surface of the lower extent of the interconnect for releasably coupling with the ridges of the C-shaped top of the mounting base. The interconnect ensures that the cans dispensed through the dispensing adapters are guided through the interconnect and into the container for storage purposes. Finally, a lid is included for removably securing about the peripheral lip of the container to seal the same. Note FIGS. 10 & 11. The lid has an O-ring coupled thereto for securing to the container to couple the lid to the container when the lid is not in use. The lid further has a flapper valve formed therein for being selectively opened to allow the drainage of fluid from the container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the hollowing description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved can crusher and storage system which has all the advantages of the prior art can compactors and none of the disadvantages.

It is another object of the present invention to provide a new and improved can crusher and storage system which may be easily and efficiently manufactured and marketed.

It is a further object of the present invention to provide a new and improved can crusher and storage system which is of a durable and reliable construction.

An even further object of the present invention is to provide a new and improved can crusher and storage system which is susceptible of a low cost of manufacture with regard to both materials and labor, and which accordingly is then susceptible of low prices of sale to the consuming public, thereby making such can crusher and storage system economically available to the buying public.

Still yet another object of the present invention is to provide a new and improved can crusher and storage system which provides in the apparatuses and methods of the prior art some of the advantages thereof, while simultaneously overcoming some of the disadvantages normally associated therewith.

Still another object of the present invention is to crushing cans and further storing such crushed cans in a container prior to recycling.

Another object of the present invention is to render the act of recycling both convenient and more efficient so as to afford at a greater extent the benefits of recycling.

Lastly, it is an object of the present invention to provide a new and improved can crusher and storage system including a piston housing having a first face, a second face, and a periphery formed therebetween defining an interior space. The piston housing has an inlet formed in the periphery thereof adjacent the first face. A thin rectangular outlet is formed in the periphery of the piston housing between the inlet and the first face and is further situated opposite of and offset from the inlet. Next provided is a piston assembly situated within the interior space of the piston housing for crushing cans situated within the inlet upon the actuation thereof. A control assembly is provided for selectively actuating the piston assemble.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an exploded view of the mounting base, container, dispensing adapters, and interconnect of the present invention.

FIG. 7 is a cross-sectional view of the interconnection between the dispensing adapters of the present invention.

FIG. 8 is a top view of the interconnect of the present invention.

FIG. 9 is an exploded view of the mounting base and interconnect of the present invention.

Similar reference characters refer to similar parts throughout the several views of the drawings.

DESCRIPTION OF THE PREFERRED EMBODIMENT

Figure 1:
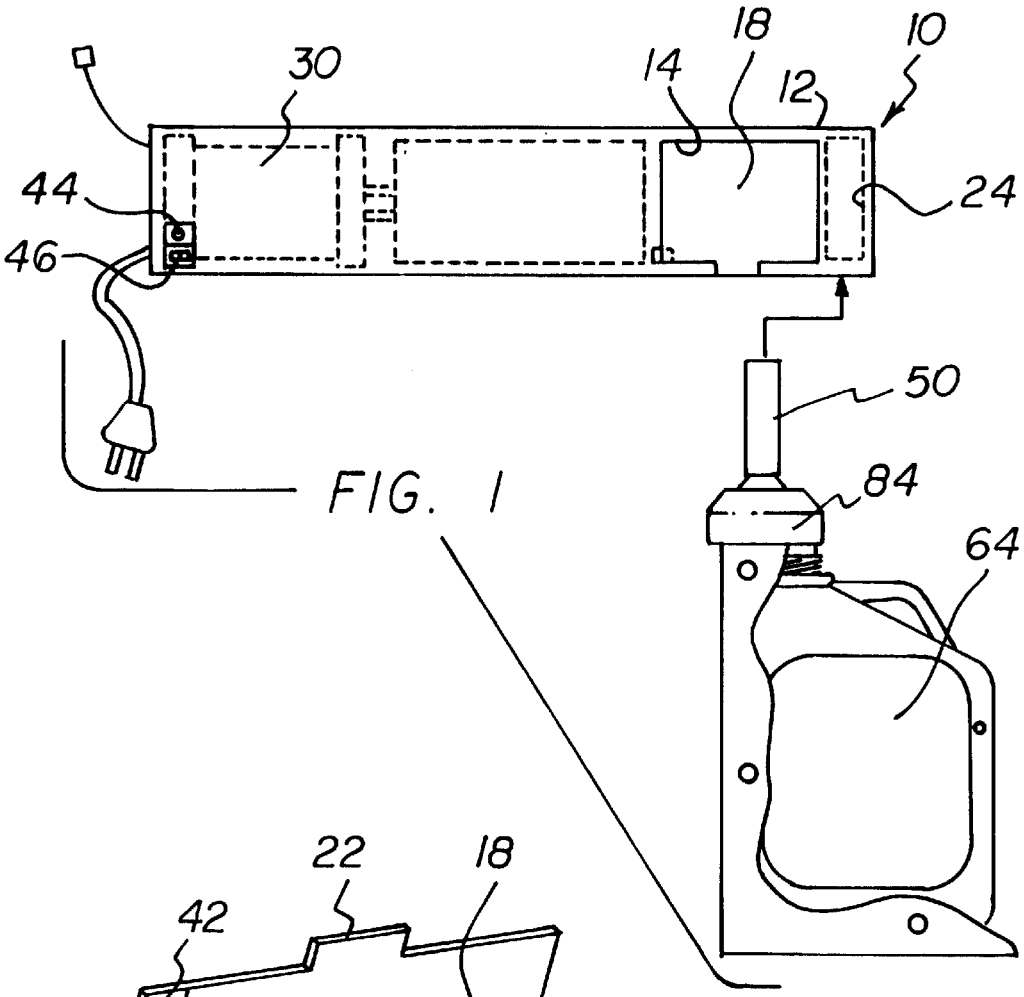
FIG. 1 is an illustration of the preferred embodiment of the can crusher and storage system constructed in accordance with the principles of the present invention.
Figure 2:
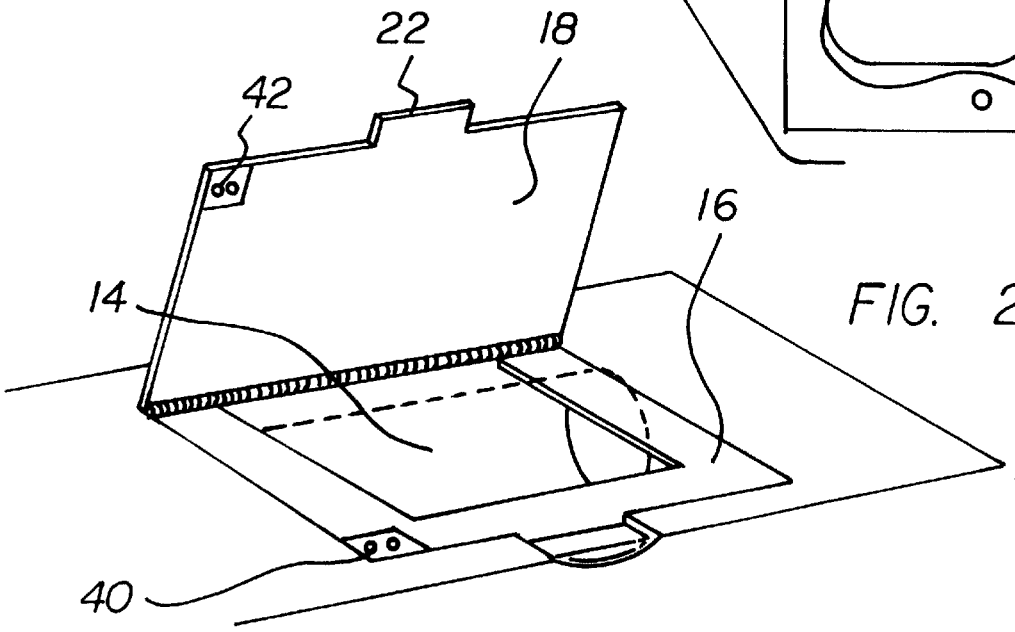
FIG. 2 is a perspective view of the inlet and lid of the piston housing of the present invention.

With reference now to the drawings, and in particular to FIG. 1 thereof, a new and improved can crusher and storage system embodying the principles and concepts of the present invention and generally designated by the reference numeral 10 will be described.

The present invention, the new and improved can crusher and storage system, is comprised of a plurality of components. Such components in their broadest context include a piston housing, dispensing adapters, mounting base, interconnect, lid and electrical control assembly. Such components are individually configured and correlated with respect to each other so as to attain the desired objective.

More specifically, it will be noted that the system 10 of the present invention includes a piston housing 12 having a cylindrical configuration. As shown in FIG. 1, the piston housing has a first circular face, a second circular face, and a tubular periphery formed therebetween defining an interior space. While not shown, it should be understood that the piston housing may be equipped with a mounting plate for coupling the piston housing to a recipient surface at various angles, elevations, and the like.

Figure 3:
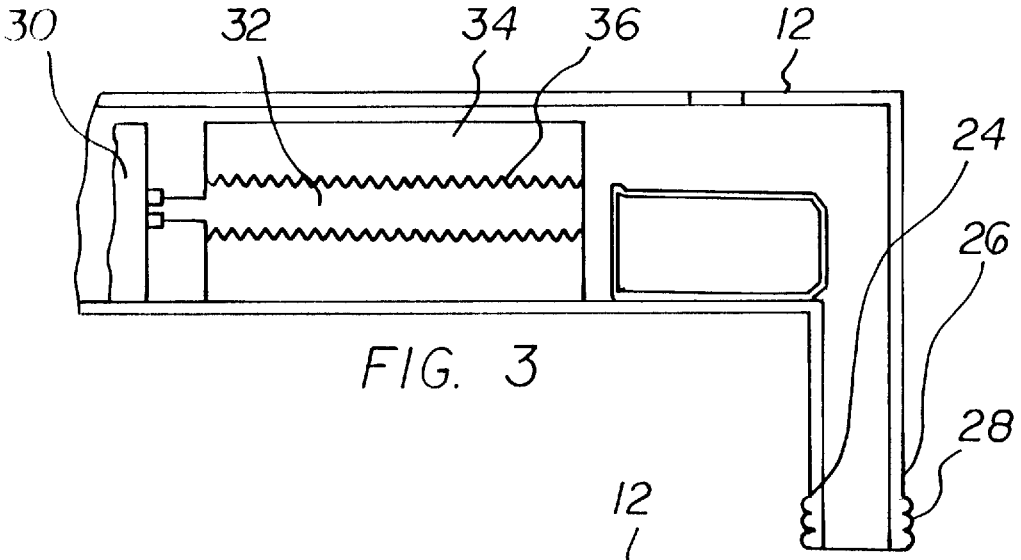
FIGS. 3–5 are cross-sectional views of the piston assembly during use.
Figure 4:
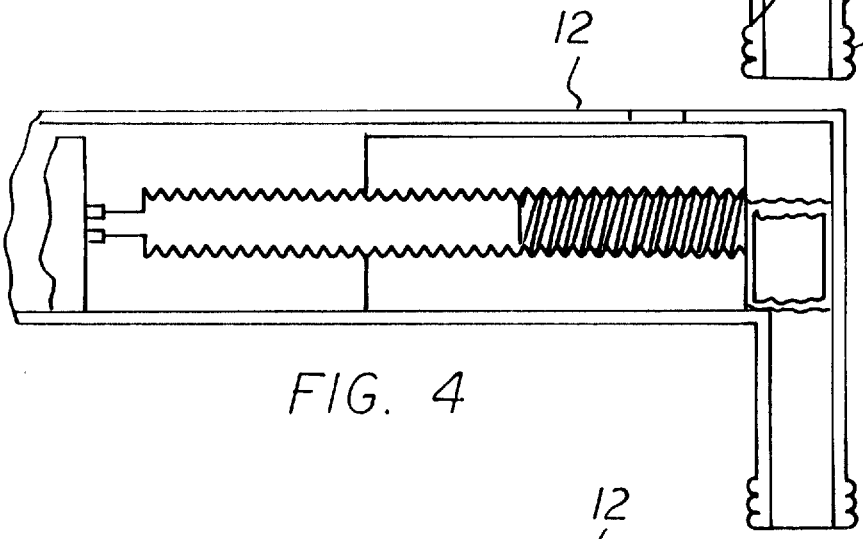
Figure 5:
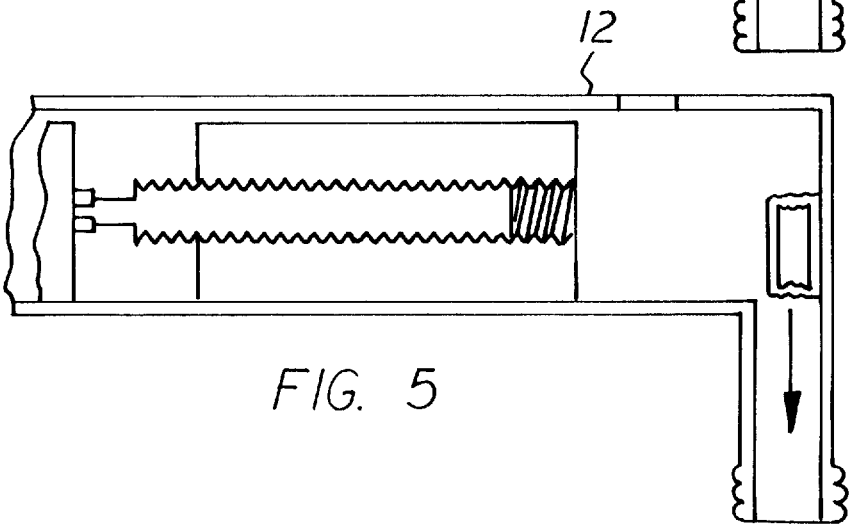

A rectangular inlet 14 is formed in the periphery of the piston housing adjacent the first circular face. A recessed lip 16 is formed about an inner periphery of the inlet. A spring biased lid 18 is hingably coupled over the inlet with a biased open orientation and an unbiased closed orientation. To facilitate the opening of the lid, a tab 22 is extended therefrom. A thin rectangular outlet 24 is formed in the periphery of the piston housing between the inlet and the first circular face. As shown in FIG. 1, the outlet is further situated diametrically opposite of and offset from the inlet. As best shown in FIGS. 3–5, a rectangular chute 26 is integrally coupled about the outlet and extends radially therefrom. As an option, the chute may be angled with respect to the piston housing for accommodating various applications. For reasons that will become apparent later, a plurality of undulations 28 are formed about an outer surface of the chute.

With references still to FIGS. 3–5, it is shown that a piston assembly is provided including a motor 30 mounted within the interior space of the piston housing adjacent the second circular face thereof. A screwdriver shaft 32 is coupled to a rotor of the motor and extends in concentric relationship with the piston housing. A piston 34 with a cylindrical configuration is slidably situated within the interior space of the piston housing with a threaded coaxial bore 36 formed therein for threadedly receiving the screwdriver shaft. The piston is imperatively slidably situated within the housing such that rotation is precluded. This is preferably accomplished by way of a tongue and groove combination. In the preferred embodiment, an annular bushing encompasses the piston to prevent fluid from contacting the motor.

Upon the actuation of the motor, the motor is adapted to rotate the screwdriver shaft such that the piston engages the first circular face and subsequently retracts to a rest position adjacent the motor. Limit switches may be employed to afford such operation. As such, a can is crushed when inserted within the inlet thereby allowing the expelling of the crushed can through the outlet for disposal.

In alternate embodiments, the piston housing may be vertically oriented or slanted with the piston adapted to abut either one of the circular faces. In such embodiments, the outlet may be situated at various points along the piston housing and both an engagement surface of the piston and the circular face which it abuts may be beveled to effect the sliding of the crushed can via gravity through the outlet as the piston is retracted.

For controlling the operation of the piston assembly, an electrical control assembly is included. Such assembly includes a pair of contacts 40 situated on the recessed lip of the inlet of the piston housing. Associated therewith is a conductive tab 42 mounted on the lid. Upon the lid residing in the open orientation thereof, a first activation signal is transmitted. When the lid is in the closed orientation thereof, a second activation signal is transmitted. It should be understood that the transmission of the signals is accomplished by the shorting and opening of the contacts. The electrical control assembly further includes a push button 44 mounted on an exterior of the piston housing. During use, the push button serves for generating a third activation signal upon the depression thereof.

The electrical control assembly further includes a mode switch 46 situated on the exterior of the piston housing for effecting the operation of the electrical control assembly in a first mode of operation in a first orientation and effecting the operation of the control assembly in a second mode of operation in a second orientation. Finally, unillustrated control means is connected between the motor, contacts, push button, and mode switch. In use, the control means functions to effect the actuation of the motor after a predetermined amount of time upon the receipt of the first activation signal and the subsequent receipt of the second activation signal in the first mode of operation. The predetermined amount of time is preferably 3 seconds. As such, the crushing of the can is effected upon the opening and subsequent closing of the lid. The electrical control assembly is further adapted to effect the immediate actuation of the motor upon the receipt of the third activation signal in the second mode operation. In such mode, the crushing of the can is effected upon the depression of the push button. It should be noted that, in either mode of operation, the control means requires that the contacts be shorted for the motor to be actuates for safety reasons.

In the preferred embodiment, the relay mechanism may either be built into the motor or reside in an external circuit. Such relay mechanism performs both the timer function and further has memory means for storing the amount of rotations required to abut the piston with the circular face.

With attention now to FIGS. 6 & 7, a plurality of dispensing adapters 50 each have a hollow rectangular cross-section with a pair of open ends. Each of the dispensing adapters have a top end with a plurality of peripheral undulations 52 formed on an interior surface thereof. A bottom end of each of the dispensing adapters is equipped with a plurality of peripheral undulations 53 formed on an exterior surface thereof. By this structure, the dispensing adapters may be coupled in linear alignment and further coupled to the chute of the piston housing for receiving a crushed can dispensed therefrom. In the alternative, the dispensing adapters may comprise of either "A" or "B" elbows for accomodating various applications.

Also included is a mounting base 54 having an L-shaped configuration, as shown in FIGS. 1, 6 & 9. The mounting base is equipped with a pair of side walls 56 defining an L-shaped channel. The mounting base further has a plurality of apertures 58 formed therein for fixedly coupling the same to a recipient surface. As best shown in FIG. 9, the mounting base has a C-shaped top 60 having a plurality of ridges 62 formed on an exterior surface thereof.

Figure 10:
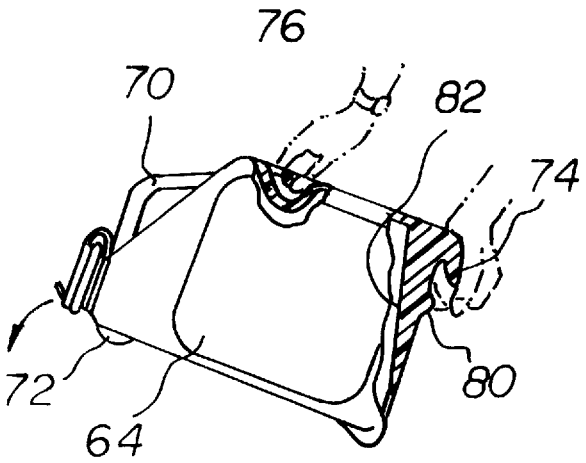
FIG. 10 is a side view of the container showing the interior space thereof.

As shown in FIG. 10, a hollow container 64 is included having a top face, a bottom face, a front face, a rear face, and a pair of side faces integrally coupled therebetween thereby defining an interior space. The container has a circular opening 66 formed on the top face adjacent the front face thereof. It is imperative that such opening be of a greater diameter than that of the C-shaped top 60 thereby ensuring that all liquid is funneled into the container. A peripheral lip 68 is coupled about the circular opening and extends upwardly therefrom. An inverted V-shaped handle 70 is integrally coupled to the top face of the container. A pair of protrusions 72 are integrally formed in the front face and extend outwardly therefrom. For facilitating the handling of the container and further maintaining the container level when residing in the L-shaped mounting base, a gripping arm 74 is integrally coupled to the bottom face of the container adjacent the rear face thereof. A gripping inset portion 76 is integrally formed in the rear face of the container adjacent to the top face thereof for further facilitating the handling of the container. Basically, the inset portion includes a recess shaped to allow handling by a user.

A locking bump 80 is formed in the bottom face of the container and extends downwardly therefrom for engaging an unillustrated, similarly shaped complimentary bump formed in the mounting base when the container is situated within the L-shaped channel of the mounting base. The bumps work together for maintaining the container within the mounting base such that the circular opening of the container is in coaxial alignment with the C-shaped top of the mounting base. The bottom face of the container has a beveled upper surface 82 within the interior space of the container for effecting the flow of fluid to the front face of the container.

FIGS. 8 & 9 show an interconnect 84 having an upper extent with a rectangular cross-section. The upper extent has a plurality of peripheral undulations formed in an interior surface thereof for engaging those of the bottom end of the one of the dispensing adapters. The interconnect further has a lower extent with an outer portion having a circular cross-section and an inner portion which is an extension of the upper extent of the interconnect. Note FIG. 9. A plurality of indentations 86 are formed in an interior surface of the lower extent for releasably coupling with the ridges of the C-shaped top of the mounting base. The interconnect ensures that the cans dispensed through the dispensing adapters are guided through the interconnect and into the container for storage purposes.

Figure 11:
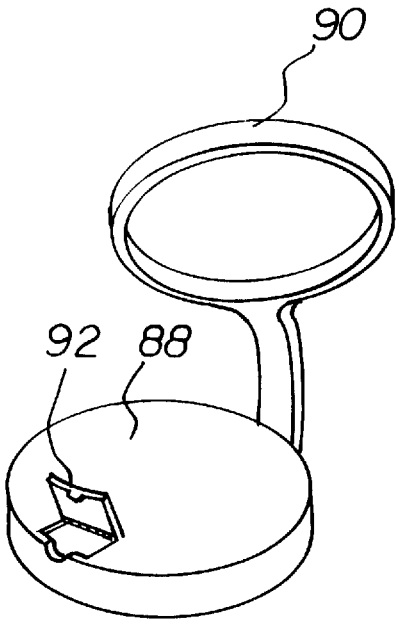
FIG. 11 is a perspective view of the lid of the present invention.

Finally, a lid 88 is included for removably securing about the peripheral lip of the container to seal the same. Note FIGS. 10 & 11. The lid has an O-ring 90 coupled thereto for securing to the container to couple the lid to the container when the lid is not in use. The lid further has a flapper valve 92 formed therein for being selectively opened to allow the drainage of fluid from the container.

Figure 12:
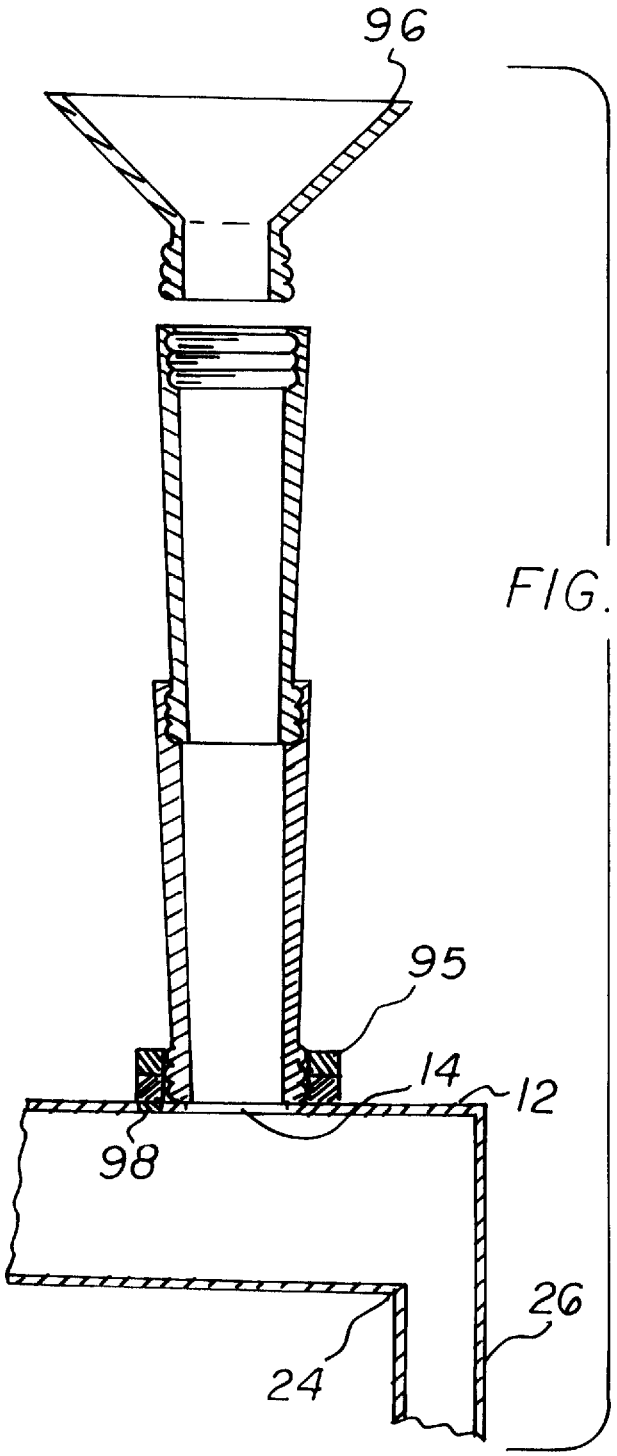
FIG. 12 is an illustration of an alternate embodiment of the present invention.

As an option, the hinged lid of the piston housing may be removed from the inlet and a boot 95 releasably mounted on the recessed lip formed about the inlet of the piston housing. Preferably, a bottom of the boot has a contact 98 situated thereon for shorting the contacts of the recessed lip thereby allowing the operation of the electrical control assembly in the second mode of operation. The boot is adapted to be releasably coupled to a bin 96. In use, the bin serves for receiving cans therein and directing the same into the inlet. In the alternative, a plurality of dispensing adapters may be coupled between the inlet and the bin for allowing such components to remain distant during use. See FIG. 12. It is imperative that the dispensing adapters connected with the bin and boot have a larger cross-sectional area than those connected to the outlet of the piston assembly to accommodate full sized cans.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by UTILITY PATENT of the United States is as follows:

1. A can crusher and storage system comprising, in combination:

a piston housing having a cylindrical configuration with a first circular face, a second circular face, and a tubular periphery formed therebetween defining an interior space, the piston housing having a rectangular inlet formed in the periphery thereof adjacent the first circular face with a recessed lip formed about an inner periphery of the inlet, a spring biased lid hingably coupled over the inlet with a biased open orientation and an unbiased closed orientation, a thin rectangular outlet formed in the periphery of the piston housing between the inlet and the first circular face and further situated diametrically opposite of and offset from the inlet, and a rectangular chute integrally coupled about the outlet and extending radially therefrom with a plurality of undulations formed about an outer surface thereof;

a piston assembly including a motor mounted within the interior space of the piston housing adjacent the second circular face thereof, a screwdriver shaft coupled to a rotor of the motor and extending in concentric relationship with the piston housing, and a piston with a cylindrical configuration slidably situated within the interior space of the piston housing with a threaded coaxial bore formed therein for threadedly receiving the screwdriver shaft, whereby upon the actuation of the motor, the motor is adapted to rotate the screwdriver shaft such that the piston engages the first circular face and subsequently retracts to a rest position adjacent the motor thereby crushing a can inserted within the inlet and allowing the expelling of the crushed can through the outlet for disposal;

an electrical control assembly including a pair of contacts situated on the recessed lip of the inlet of the piston housing and a conductive tab mounted on the lid such that upon the lid residing in the open orientation thereof, a first activation signal is transmitted and upon the lid residing in the closed orientation thereof, a second activation signal is transmitted, the electrical control assembly further including a push button mounted on an exterior of the piston housing for generating a third activation signal upon the depression thereof, a mode switch situated on the exterior of the piston housing for effecting the operation of the electrical control assembly in a first mode of operation in a first orientation and effecting the operation of the control assembly in a second mode of operation in a second orientation, and control means connected between the motor, contacts, push button, and mode switch, the control means adapted to effect the actuation of the motor after a predetermined amount of time upon the receipt of the first activation signal and the subsequent receipt of the second activation signal in the first mode of operation thereby effecting the crushing the can upon the opening and subsequent closing of the lid, the electrical control assembly further adapted to effect the immediate actuation of the motor upon the receipt of the third activation signal in the second mode of operation thereby effecting the crushing of the can upon the depression of the push button;

a plurality of dispensing adapters each having a hollow rectangular cross-section with a pair of open ends, the dispensing adapters each having a top end with a plurality of peripheral undulations formed on an interior surface thereof and a bottom end with a plurality of peripheral undulations formed on an exterior surface thereof, whereby the dispensing adapters may be coupled in linear alignment and further coupled to chute of the piston housing for receiving a crushed can dispensed therefrom;

a mounting base having an L-shaped configuration with a pair of side walls defining an L-shaped channel, the mounting base having a plurality of apertures formed therein for fixedly coupling the same to a recipient surface, the mounting base having a C-shaped top having a plurality of ridges formed on an exterior surface thereof;

a hollow container having a top face, a bottom face, a front face, a rear face, and a pair of side faces integrally coupled therebetween thereby defining an interior space, the container having a circular opening formed on the top face adjacent the front face of the container with a peripheral lip coupled thereabout and extending upwardly therefrom, an inverted V-shaped handle integrally coupled to the top face of the container, a pair of protrusions integrally formed in the front face and extending outwardly therefrom, a gripping arm integrally coupled to the bottom face of the container adjacent the rear face thereof for facilitating the handling of the container, a gripping inset portion integrally formed in the rear face of the container adjacent to the top face thereof for facilitating the handling of the container, and a locking bump formed in the bottom face of the container and extending downwardly therefrom for engaging a complimentary bump formed in the mounting base when the container is situated within the L-shaped channel of the mounting base for maintaining the container therein, whereby the circular opening of the container is in coaxial alignment with the C-shaped top of the mounting base when mounted therein, the bottom face of the container having a beveled upper surface within the interior space of the container for effecting the flow of fluid to the front face of the container;

an interconnect having an upper extent with a rectangular cross-section and a plurality of peripheral undulations formed in an interior surface thereof for engaging those of the bottom end of the one of the dispensing adapters and a lower extent with a circular cross-section and having a plurality of indentations formed in an interior surface thereof for releasably coupling with the ridges of the C-shaped top of the mounting base, whereby cans dispensed through the dispensing adapters are guided through the interconnect and into the container for storage purposes; and a lid for removably securing about the peripheral lip of the container for sealing the same, the lid having an O-ring coupled to the lid for securing to the container to coupling the lid to the container when the lid is not in use, the lid further having a flapper valve formed therein for being selectively opened to allow the drainage of fluid from the container.

2. A can crusher and storage system comprising:

a piston housing having a first face, a second face, and a periphery formed therebetween defining an interior space, the piston housing having an inlet formed in the periphery thereof adjacent the first face, a thin rectangular outlet formed in the periphery of the piston housing between the inlet and the first face and further situated opposite of and offset from the inlet;

a piston assembly situated within the interior space of the piston housing for crushing cans situated within the interior space upon the actuation thereof;

a control assembly for selectively actuating the piston assembly; and a plurality of dispensing adapters each having a hollow cross-section with a pair of open ends each having a coupling means formed thereon, whereby the dispensing adapters may be coupled in linear alignment and further coupled to the outlet of the piston housing for receiving a crushed can dispensed therefrom.

3. A can crusher and storage system as set forth in claim 2 wherein the piston assembly includes a motor mounted within the interior space of the piston housing adjacent the second face thereof, a screwdriver shaft coupled to a rotor of the motor and extending in concentric relationship with the piston housing, and a piston with a cylindrical configuration slidably situated within the interior space of the piston housing with a threaded coaxial bore formed therein for threadedly receiving the screwdriver shaft.

4. A can crusher and storage system as set forth in claim 2 wherein a lid is situated about the inlet of the housing.

5. A can crusher and storage system as set forth in claim 4 wherein the motor is actuated upon the opening and closing of the lid.

6. A can crusher and storage system as set forth in claim 4 wherein the motor is actuated after a predetermined amount of time upon the opening and closing of the lid.

7. A can crusher and storage system as set forth in claim 2 and further including a push button, whereby the motor is actuated immediately upon the depression of the push button.

8. A can crusher and storage system as set forth in claim 2 wherein the coupling means includes a plurality of peripheral undulations formed on an interior surface of a top end of each dispensing adapter and a plurality of peripheral undulations formed on an exterior surface of a bottom end of each dispensing adapter.

9. A can crusher and storage system as set forth in claim 2 wherein a collection bin is releasably mounted to the inlet of the piston housing for receiving cans therein and directing the same into the inlet.

10. A can crusher and storage system comprising:

a piston housing having a first face, a second face, and a periphery formed therebetween defining an interior space, the piston housing having an inlet formed in the periphery thereof adjacent the first face, a thin rectangular outlet formed in the periphery of the piston housing between the inlet and the first face and further situated opposite of and offset from the inlet;

a piston assembly situated within the interior space of the piston housing for crushing cans situated within the interior space upon the actuation thereof;

a control assembly for selectively actuating the piston assembly; and a container for receiving crushed cans from the outlet of the piston housing for storage and transportation purposes;

wherein a bottom face of the container has a beveled upper surface within an interior space of the container for effecting the flow of fluid to the front face of the container.

11. A can crusher and storage system as set forth in claim 10 and further including a mounting base for receiving the container while receiving cans from the outlet of the piston housing.

12. A can crusher and storage system as set forth in claim 11 and further including a plurality of dispensing adapters each having a hollow cross-section with a pair of open ends each having coupling means formed thereon, whereby the dispensing adapters may be coupled in linear alignment and further coupled to the outlet of the piston housing for receiving a crushed can dispensed therefrom, and further including an interconnect for coupling the dispensing adapters to the mounting base such that the dispensing adapters are in alignment with the opening of the container.

13. A can crusher and storage system as set forth in claim 11 wherein the container includes a locking bump formed in a bottom face thereof and extends downwardly therefrom for engaging a complimentary bump formed in the mounting base when the container is situated therein.

14. A can crusher and storage system as set forth in claim 10 wherein the container includes an inverted V-shaped handle integrally coupled to a top face thereof.

15. A can crusher and storage system as set forth in claim 10 wherein the container includes a pair of protrusions integrally formed in a front face thereof.

16. A can crusher and storage system as set forth in claim 10 wherein the container includes a gripping arm integrally coupled to a bottom face of the container adjacent a rear face thereof for facilitating the handling of the container.

17. A can crusher and storage system as set forth in claim 10 wherein the container includes a gripping inset portion integrally formed in a rear face of the container adjacent to the top face thereof for facilitating the handling of the container.

18. A can crusher and storage system as set forth in claim 10 wherein the container includes a lid for sealing the container.

* * * * *